United States Patent [19]

Comiskey

[11] 4,217,879

[45] Aug. 19, 1980

[54] FIREPLACE GRATE

[76] Inventor: William T. Comiskey, 2121 3rd St., Port Neches, Tex. 77651

[21] Appl. No.: 910,614

[22] Filed: May 30, 1978

[51] Int. Cl.[2] ..... F24B 7/00

[52] U.S. Cl. ..... 126/121; 126/164

[58] Field of Search ..... 126/121, 164, 298, 129, 126/130, 131, 120; D23/94, 95, 96

[56] References Cited

U.S. PATENT DOCUMENTS

| | | | |
|---|---|---|---|
| 1,418,411 | 6/1922 | Ward | 126/298 |
| 2,585,523 | 2/1952 | Wellman | 126/298 |
| 2,600,753 | 6/1952 | Gilbert | 126/298 |
| 2,901,212 | 8/1975 | Stites | 126/121 |
| 2,985,165 | 5/1961 | Peterson et al. | 126/165 |
| 3,505,986 | 4/1970 | Wood | 126/165 |
| 4,018,210 | 4/1977 | Christophel | 126/164 |
| 4,069,808 | 1/1978 | Cranberg | 126/164 |

OTHER PUBLICATIONS

*The Amateur Scientist:* Scientific American, Aug. 1978, pp. 143–146.

*Primary Examiner*—Carroll B. Dority, Jr.
*Assistant Examiner*—Lee E. Barrett
*Attorney, Agent, or Firm*—Sigalos & Levine

[57] ABSTRACT

A fireplace grate comprising a first plurality of parabolic shaped solid fuel supports having a first focal length and being arranged in a rigid side-by-side relationship in a vertical plane, a second plurality of parabolic shaped solid fuel supports having a second focal length and being arranged in side-by-side relationship in a vertical plane and interspersed with said first supports whereby said first and second supports define a chamber for receiving and stacking solid fuel in a generally parabolic configuration, and a base support member rigidly maintaining said fuel supports in their side-by-side relationship and holding said solid fuel above the fireplace hearth.

4 Claims, 4 Drawing Figures

FIREPLACE GRATE

BACKGROUND OF THE INVENTION

It has long been recognized in the art that fireplace grates merely provide support for one or more logs to raise them above the hearth of a fireplace and that a fireplace is inefficient from the standpoint of utilizing radiant heat from the burning logs. Several different types of andirons or grates have been proposed in the prior art in an attempt to alleviate problems and provide more efficient operation and utilization of the fireplace for heating purposes.

Thus, it is pointed out in U.S. Pat. No. 2,600,753 that the major source of useful heat given off by burning logs in a fireplace is radiant heat emitted by the burning or incandescent logs. Convection cannot play an important part in transfer of heat from a fireplace to a room or other space which is being heated because the draft necessary for operation of the fireplace is from the room into the fireplace and thence upwardly through the flue. It is also pointed out that the hottest, incandescent part of a burning log supported on a grate is the undersurface of the logs. However, it is that precise area that is shielded from direct radiation to a room or other space which is being heated. The grate or andiron disclosed in U.S. Pat. No. 2,600,753 purports to solve this problem by providing andirons which support burning or incandescent logs so as to radiate heat efficiently into a room or other space which it is desired to heat by dividing a bar extending upwardly and outwardly for holding a supply of main logs in an elevated position relative to the hearth of a fireplace and to allow heat from the undersurface of the logs to radiate outwardly from the fireplace, and an auxiliary rod located beneath the upper bar and extending outwardly to support an auxiliary log in a position under the main log to support combustion thereof.

Other proposals to improve the efficiency of fireplaces have included grate type structures for supporting burning fuels such as wood, coal or other solid fuel and having air conveying tubes formed by the grate members for receiving air from the room to be served by the fireplace grate structure, passing the air through the tubes in good heat exchange relation with the burning fuel, and discharging the air back into the room to enhance the heating efficiency. Typical of these structures are those disclosed in U.S. Pat. Nos. 1,030,002, 1,313,085; 1,608,745; and 1,747,259, all of which employ a plurality of hollow tubular members arranged in a generally C-shaped configuration having a lower leg provided with an air inlet to receive air from the room and conduct the same rearwardly, and then upwardly and forwardly about the burning fuel to achieve better heating of the air and then discharge the heated air back into the living space. These devices all rely upon convection currents produced by the heating of the air in the tubular members to draw room air into the lower legs of the tubular members and achieve air circulation movement rearwardly, upwardly, and forwardly through the members to discharge heated air back into the room. The structure disclosed in U.S. Pat. No. 4,018,210 further improved upon the fireplace grate type structures by providing a structure which included a pressurized manifold and associated motor driven fan incorporated in the fireplace grate unit and communicating with the openings at the lower ends of the tubes to distribute pressurized air to the lower inlets of the tubes to be heated during passage through the tubes and discharged in the desired direction back into the room to be heated.

None of the prior art structures are so designed as to give maximum heating and heat radiation efficiency from the fireplace combustion.

SUMMARY OF THE INVENTION

The present invention provides a fireplace heat radiator which greatly improves the efficiency of a fireplace by providing a fireplace grate which is so constructed that it holds the solid fuel such as logs, in a parabolic configuration which concentrates the radiated heat outwardly into the room.

Specifically, the fireplace grate comprises a first plurality of parabolic shaped solid fuel supports having a first focal plane length and arranged in side-by-side relationship in a vertical plane, a second plurality of parabolic shaped solid fuel supports having a second and shorter focal plane length and arranged in side-by-side relationship in a vertical plane and interspersed with said first supports whereby said first and second supports define a chamber for receiving and stacking solid fuel in a generally parabolic configuration to provide improved combustion and to direct heat radiation out into the room. A base support member rigidly maintains said parabolic supports in their side-by-side relationship and holds the solid fuel above the fireplace hearth.

The parabolic shaped supports are hollow tubes of substantially parabolic configuration whereby ambient air is drawn into said tubes at the bottom thereof and is heated and discharged back into the room being served by the fireplace. If it is desired, a plenum chamber may be constructed about the tube inlets and a fan connected thereto to force ambient air into said tubes where it would be heated and returned to the room being served by the fireplace.

BRIEF DESCRIPTION OF THE DRAWINGS

These and other objects and advantages of the present invention will become apparent on reading the following detailed description of the preferred and alternate embodiments thereof in relation to the accompanying drawings in which.

BRIEF DESCRIPTION OF THE PREFERRED EMBODIMENT

Figure 1:
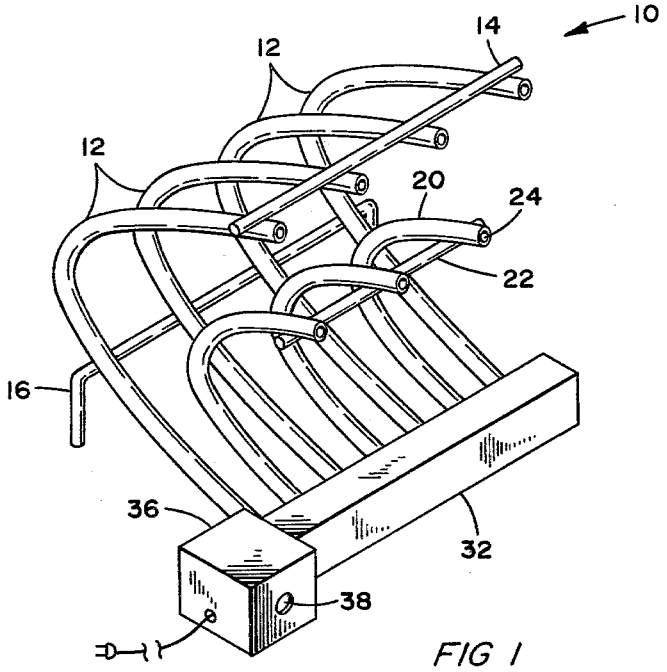
FIG. 1 is a perspective view of the novel fireplace grate structure constructed in accordance with the preferred embodiment of the present invention.
Figure 2:
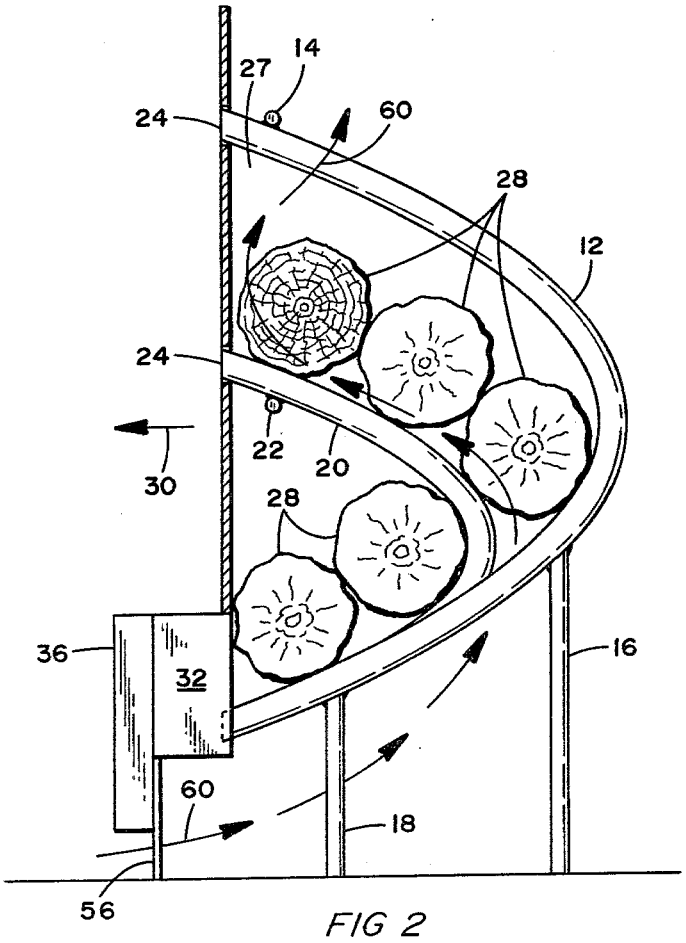
FIG. 2 is a side view of the novel fireplace grate structure installed in a fireplace and illustrating the parabolic stacking of the solid fuel.

Referring now to the drawings, wherein like reference numerals designate corresponding parts throughout the several figures, the fireplace grate structure of the present invention as shown in FIG. 1 is indicated generally by the numeral 10 and is adapted to be disposed wholly within the fireplace recess or chamber, not shown. The structure comprises a first plurality of generally parabolic shaped solid fuel supports 12 having a first focal plane length arranged in side-by-side relationship in a vertical plane to define a first concave cradle. Support rod 14 and base legs 16 and 18, shown in FIG. 2, form a base support member which may be added if desired to adjust the height and horizontal position of the cradle and may be spot welded to said solid fuel supports 12 if necessary to maintain them in a rigid side-by-side relationship and to provide a base for said solid fuel supports 12 and to position the burning area for the solid fuel with respect to the fireplace hearth. A second plurality of generally parabolic shaped solid fuel supports 20 having a different height than said supports 12 and a second, shorter focal plane length are arranged in side-by-side relationship in a vertical plane to define a second concave cradle and are interspersed with said first supports 12 whereby, as shown in FIG. 2, the space 27 formed between the heights of said parabolic supports forms or defines a chamber for receiving and stacking solid fuel such as logs 28 in a generally parabolic configuration. Bolts may be used to pass through any two adjacent tubes 12 and 20 separated by a spacer to hold them in a rigid position. However, if desired, a support rod 22 and base leg 18 may be spot welded to said second plurality of supports 20 as necessary to maintain them in a rigid side-by-side relationship in a vertical plane and to position the base of said parabolic shaped fuel support 20 with respect to the hearth so that solid fuel such as logs is maintained in a position above the hearth to allow air for combustion purposes to circulate thereunder as shown in FIG. 2 by arrows 60 representing the direction of the air flow.

Figure 3:
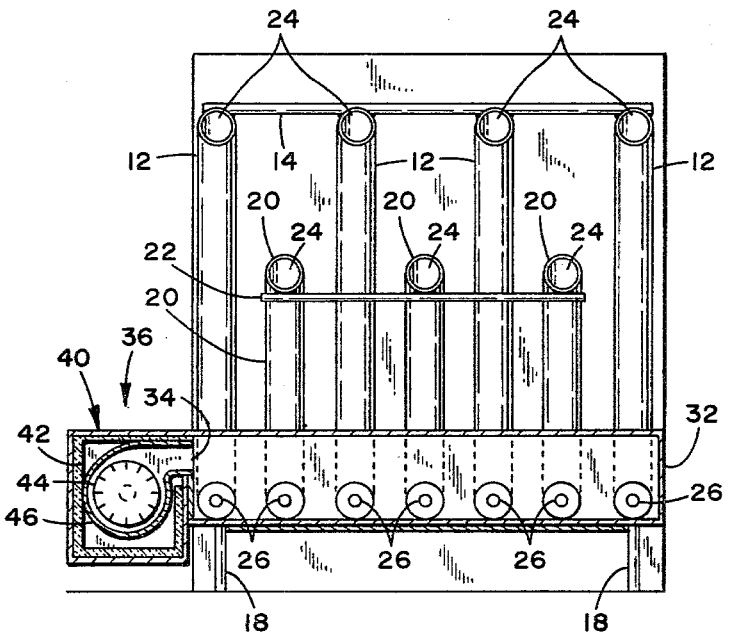
FIG. 3 is a front view of the novel fireplace grate structure partially in sections showing the inside of the plenum chamber and fan.

Said solid fuel supports 12 and 20 may be formed of hollow tubes open at both ends 24 and 26. As the air within the tubes begins to heat, it rises, thus pulling in air at the base 26 as shown in FIG. 3 and discharging the heated air back into the room at 24.

Notice in FIG. 2 that one plurality of parabolic shaped fuel supports 20 pass within the parabolas formed by the stacked fireplace logs and the first plurality of parabolic shaped supports 12. Not only is the greatest heat being generated immediately under logs 28 which are stacked in a parabolic configuration because of the relationship of the two sets of fuel supports 12 and 20, but also, that heat will generally be reflected outwardly in paths in the direction of arrow 30 parallel to the axis of symmetry of the parabola. Radiation produced under the burning logs ends up as an increase in flame and eventually, more heat which passes out into the room.

Thus, several advantages occur from the use of the solid fuel or logs 28 stacked in a generally parabolic configuration. First, better burning takes place since the heat is concentrated under the logs. Secondly, the radiation is directed outwardly into the room because the heat being developed under the upper logs 28 is emitted outwardly generally in a horizontal direction into the room.

Third, two sets of hollow tubes forming the grate with one set of the tubes passing generally under the upper logs 28, the hottest point, produces warmer air being returned to the room.

Fourth, the parabolic stacking of logs 28 allows a draft indicated by arrows 60 which passes under logs 28 to create better burning conditions. Thus, the logs 28 are easier to keep burning.

The base 26 of tubes 12 and 20 may be left open to the room. However, if desired, a plenum chamber in the form of an elongated manifold 32 which spans transversely the inlet ends 26 of both the first and second plurality of solid fuel supports or tubes 12 and 20 are being otherwise enclosed except for inlet 34 may be used to force ambient air into said hollow fuel supports 12 and 20. An air propelling fan 36 may be attached to manifold 32 to cover inlet 34. Fan 36 is enclosed in a housing 40 lined with suitable insulation 42 rated as necessary to protect the contents of the box against the heat of the fire from the fuel supported by the solid fuel supports 12 and 20. Such insulation may be necessary to withstand 2300° F.

As shown in FIG. 1, inlet 38 receives air from the room and permits it to pass through the center portion of impeller or rotor 44 of a fan such as a squirrel cage type fan of conventional commercial construction surrounded by a chamber indicated by 46. See FIG. 3. The outlet portion of the chamber 46, which is usually of spiral configuration, connects to and terminates at inlet 34 of plenum chamber 32. Inlet 34, of course, communicates with the interior of the plenum or manifold 32 at one end thereof and provides the air passage for pressurizing the manifold.

Figure 4:
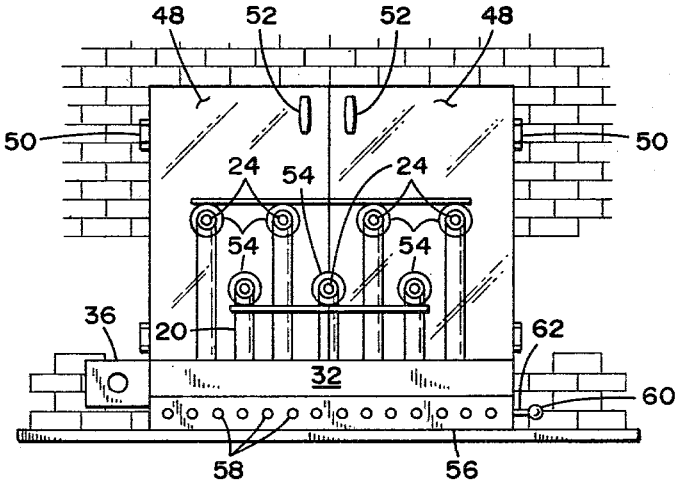
FIG. 4 is a front view of the novel fireplace grate structure installed in a fireplace with glass doors enclosing said fireplace.

If it is desired to use the novel parabolic grate structure in a fireplace having a glass fireplace screen or glass doors, the system can be utilized as shown in FIG. 4 wherein glass doors 48 are attached by hinges 50 in any well known manner to the fireplace structure and have handles 52 for opening the doors as desired. Glass doors 48 each has orifices 54 therein through which the open ends 24 of support tubes 12 and 20 can discharge the heated air back into the room. If desired, air regulating means in the form of a decorative escutcheon 56 may be attached to the bottom of plenum chamber 32 and occupies the space between the fireplace hearth and the bottom of the plenum chamber. Escutcheon 56 has a plurality of orifices 58 therein whereby ambient air may be drawn into and under the logs 28 held by the parabolic grate structure in an S-shaped pattern to allow better combustion. Handle 60 is attached by arm 62 to a rectangular panel (not shown) which is located behind escutcheon 56 and which has a plurality of orifices which may partially or completely block orifices 58 to regulate the amount of air flow to said fireplace.

Thus, there has been disclosed, a novel parabolic grate structure for a fireplace which is so constructed as to define a chamber for receiving and stacking solid fuel such as logs in a parabolic configuration which exposes the underside of the logs which is the area where the hottest, incandescent part of the burning logs takes place. Thus, more efficient utilization of the heat generated by the burning logs and more efficient burning itself takes place because of the heat concentrated under the burning logs.

While the invention has been described in connection with a preferred embodiment, it is not intended to limit the scope of the invention to the particular form set forth, but, on the contrary it is intended to cover such alternatives, modifications, and equivalents as may be included within the spirit and scope of the invention as defined by the appended claims.

What is claimed is:

1. A fireplace grate comprising:

(a) a first plurality of hollow, parabolic shaped, solid fuel supports having a first focal plane length and being arranged in a rigid side-by-side relationship in a vertical plane, (b) a second plurality of hollow, parabolic shaped, solid fuel supports having a second and shorter focal plane length and being arranged in side-by-side relationship in a vertical plane and interspersed with said first supports whereby said first and second supports define a chamber for receiving and stacking solid fuel in a generally parabolic configuration, and (c) a base support member rigidly maintaining said fuel supports in their side-by-side relationship, and adjusting their height and horizontal position whereby ambient air drawn into said tubes at the bottom thereof will be heated and discharged back into the room being served by said fireplace.

2. A fireplace grate comprising:

(a) a first plurality of horizontally spaced, curved, hollow tubes of substantially parabolic configuration aligned in a side-by-side relationship in a vertical plane and being rigidly assembled to define a forward facing concave cradle structure to be placed in an outwardly facing relation in a fireplace chamber, and (b) a second plurality of horizontally spaced, curved, hollow tubes of substantially parabolic configuration rigidly aligned in a side-by-side relationship in a vertical plane and interspersed between adjacent ones of said first plurality of tubes and having a height less than said first plurality of tubes so as to define a chamber for receiving and stacking fireplace logs in a parabolic configuration whereby heating is concentrated within said parabola formed by said logs to provide improved combustion, heat radiation and heating of ambient air drawn into said tubes at the bottom thereof and discharged back into the room being served by said fireplace.

3. A fireplace grate comprising:

(a) a first plurality of horizontally spaced, curved, hollow tubes of substantially parabolic configuration aligned in side-by-side relationship in a vertical plane and being rigidly assembled to form a first forward facing, log receiving, concave cradle structure to be placed in an outwardly facing relationship in a fireplace chamber, and (b) a second plurality of horizontally spaced, curved, hollow tubes of substantially parabolic configuration rigidly aligned in a side-by-side relationship in a vertical plane and interspersed between adjacent ones of said first plurality of tubes to define a second concave cradle and being of a height greater than said first plurality of tubes to form a chamber between the heights of said first and second parabolic tubes for receiving and stacking fireplace logs in a parabolic configuration whereby heating is concentrated within said parabola formed by said logs to provide improved combustion, heat radiation and heating of ambient air drawn into said tubes at the bottom thereof and discharged back into the room being served by said fireplace.

4. A fireplace grate as in claims 1, 2 or 3 wherein said first plurality of hollow tubes passes generally within the parabola formed by said stacked fuel whereby said first plurality of tubes are subjected to maximum heating.

* * * * *